US008419467B2

(12) United States Patent
Montena

(10) Patent No.: US 8,419,467 B2
(45) Date of Patent: Apr. 16, 2013

(54) COVER FOR CABLE CONNECTORS

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 141 days.

(21) Appl. No.: 12/760,134

(22) Filed: Apr. 14, 2010

(65) Prior Publication Data

US 2011/0256755 A1 Oct. 20, 2011

(51) Int. Cl.
*H01R 13/52* (2006.01)

(52) U.S. Cl.
USPC ..... 439/523; 439/588

(58) Field of Classification Search ..... 439/521, 439/523, 588, 559, 447
See application file for complete search history.

(56) References Cited

U.S. PATENT DOCUMENTS

| | | | | |
|---|---|---|---|---|
| 1,921,447 | A | 8/1933 | Barnett | |
| 1,965,151 | A | 7/1934 | Mueller | |
| 2,323,399 | A | 7/1943 | Jacobl | |
| 2,458,153 | A | 1/1949 | Festge | |
| 2,550,358 | A | 4/1951 | Le Grand et al. | |
| 2,665,673 | A | 1/1954 | Woofter | |
| 2,755,449 | A * | 7/1956 | Anderson | 439/286 |
| 2,881,406 | A | 4/1959 | Arson | |
| 2,930,022 | A * | 3/1960 | Webster | 439/472 |
| 2,946,839 | A | 7/1960 | Horning | |
| 3,120,987 | A * | 2/1964 | Degnan et al. | 439/588 |
| 3,251,020 | A * | 5/1966 | Coleman | 439/892 |
| 3,390,375 | A | 6/1968 | Salmonson | |
| 3,528,051 | A | 9/1970 | Cooper et al. | |
| 3,571,782 | A | 3/1971 | Colbert et al. | |
| 3,710,307 | A * | 1/1973 | Cooper, Jr. | 439/523 |
| 3,713,077 | A | 1/1973 | Leonard | |
| 3,753,192 | A | 8/1973 | Urani | |
| 3,792,415 | A * | 2/1974 | Fuller | 439/588 |
| 3,861,777 | A | 1/1975 | Clark | |
| 3,874,760 | A | 4/1975 | Guthmiller et al. | |
| 4,173,385 | A | 11/1979 | Fenn et al. | |
| 4,192,566 | A * | 3/1980 | Laudig et al. | 439/290 |
| 4,224,464 | A | 9/1980 | Bunnell et al. | |
| 4,283,597 | A | 8/1981 | Cooper, Jr. | |

(Continued)

FOREIGN PATENT DOCUMENTS

| | | |
|---|---|---|
| EP | 0637116 A1 | 2/1995 |
| EP | 0872915 A2 | 10/1998 |
| EP | 1249897 A1 | 10/2002 |
| GB | 2019665 A | 10/1979 |

OTHER PUBLICATIONS

U.S. Appl. No. 29/376,585, filed Oct. 8, 2010.
U.S. Appl. No. 29/381,622, filed Dec. 21, 2010.
U.S. Appl. No. 29/376,066, filed Oct. 1, 2010.

(Continued)

*Primary Examiner* — Neil Abrams
(74) *Attorney, Agent, or Firm* — Schmeiser, Olsen & Watts, LLP

(57) ABSTRACT

A cover and a system of covers for placement in sealed relation over a connector or a pair of connectors that is or are adapted to terminate a cable or splice together a pair of cables. The covers include a cable end that sealingly receives a cable therein, an elongated body that provides secure cover to a cable connector, and an end that abuts a bulkhead or sealingly engages with a second cover when used in a splicing application. For spliced cables, an adapter may be fitted into a gap between surfaces of the first and second covers to provide sealing.

4 Claims, 11 Drawing Sheets

U.S. PATENT DOCUMENTS

| | | | | |
|---|---|---|---|---|
| 4,325,600 | A | 4/1982 | Nestor | |
| 4,421,369 | A * | 12/1983 | Myking | 439/135 |
| 4,576,428 | A | 3/1986 | DeLuca et al. | |
| 4,593,962 | A | 6/1986 | Knorreck et al. | |
| 4,614,392 | A | 9/1986 | Moore | |
| 4,647,135 | A * | 3/1987 | Reinhardt | 439/460 |
| 4,822,293 | A | 4/1989 | Robson | |
| 4,869,679 | A * | 9/1989 | Szegda | 439/272 |
| 4,915,990 | A | 4/1990 | Chang | |
| 4,985,002 | A * | 1/1991 | Maisch et al. | 439/607.01 |
| 4,998,894 | A | 3/1991 | Gronvall | |
| 5,006,078 | A | 4/1991 | Crandall et al. | |
| 5,057,971 | A | 10/1991 | Hautvast et al. | |
| 5,132,495 | A | 7/1992 | Ewing et al. | |
| 5,297,971 | A | 3/1994 | Nitta et al. | |
| 5,299,951 | A | 4/1994 | Blaetz | |
| 5,338,211 | A | 8/1994 | Kodama et al. | |
| 5,397,243 | A | 3/1995 | MacMurdo, Sr. | |
| 5,401,184 | A | 3/1995 | Sundstrom et al. | |
| 5,448,017 | A | 9/1995 | Nakajima et al. | |
| 5,487,680 | A | 1/1996 | Yamanashi | |
| 5,502,280 | A | 3/1996 | Rocci et al. | |
| 5,564,951 | A | 10/1996 | Attal et al. | |
| 5,586,909 | A | 12/1996 | Saba | |
| 5,616,046 | A | 4/1997 | Sundstrom et al. | |
| 5,816,853 | A | 10/1998 | Buekers et al. | |
| 5,844,171 | A | 12/1998 | Fitzgerald | |
| 5,857,865 | A | 1/1999 | Shimirak et al. | |
| 5,857,873 | A * | 1/1999 | Castaldo | 439/588 |
| 5,886,294 | A * | 3/1999 | Scrimpshire et al. | 174/359 |
| 6,007,378 | A * | 12/1999 | Oeth | 439/588 |
| 6,109,945 | A * | 8/2000 | Creelle et al. | 439/278 |
| 6,132,250 | A * | 10/2000 | Shinozaki et al. | 439/587 |
| 6,162,087 | A * | 12/2000 | Hiura | 439/521 |
| 6,203,354 | B1 * | 3/2001 | Kuwahara et al. | 439/357 |
| 6,273,733 | B1 | 8/2001 | Uchiyama | |
| 6,305,945 | B1 | 10/2001 | Vance | |
| 6,336,821 | B1 * | 1/2002 | Hattori | 439/282 |
| 6,558,180 | B2 | 5/2003 | Nishimoto | |
| 6,652,289 | B2 | 11/2003 | Bae | |
| 6,752,655 | B1 | 6/2004 | Kaczmarek | |
| 6,887,105 | B2 * | 5/2005 | Knighten et al. | 439/607.24 |
| 6,929,265 | B2 | 8/2005 | Holland et al. | |
| 6,942,520 | B2 | 9/2005 | Barlian et al. | |
| 7,001,202 | B2 | 2/2006 | Robbins | |
| 7,056,151 | B2 * | 6/2006 | Cawood et al. | 439/521 |
| 7,179,100 | B2 | 2/2007 | Montena | |
| 7,186,127 | B2 | 3/2007 | Montena | |
| 7,195,505 | B1 * | 3/2007 | Becker | 439/282 |
| 7,216,426 | B2 | 5/2007 | Borgstrom et al. | |
| 7,311,563 | B2 | 12/2007 | Siebens et al. | |
| 7,402,063 | B2 | 7/2008 | Montena | |
| 7,407,412 | B2 * | 8/2008 | Khemakhem | 439/578 |
| 7,726,996 | B2 | 6/2010 | Burris et al. | |
| 7,731,512 | B1 | 6/2010 | Montena et al. | |
| 7,767,908 | B2 | 8/2010 | Sylvan | |
| 7,838,775 | B2 | 11/2010 | Montena | |
| D631,848 | S | 2/2011 | Montena et al. | |
| D642,538 | S | 8/2011 | Montena et al. | |
| D642,988 | S | 8/2011 | Montena et al. | |
| D642,989 | S | 8/2011 | Montena et al. | |
| D642,990 | S | 8/2011 | Montena et al. | |
| D643,372 | S | 8/2011 | Montena et al. | |
| D646,227 | S | 10/2011 | Natoli | |
| 8,062,045 | B2 | 11/2011 | Montena | |
| D656,101 | S | 3/2012 | Montena et al. | |
| D659,102 | S | 5/2012 | Natoli | |
| D664,100 | S | 7/2012 | Montena et al. | |
| 2004/0245730 | A1 | 12/2004 | Holland et al. | |
| 2006/0035508 | A1 | 2/2006 | Stekelenburg | |
| 2006/0286862 | A1 | 12/2006 | Lubinsky et al. | |
| 2011/0059662 | A1 | 3/2011 | Montena | |
| 2011/0230083 | A1 | 9/2011 | Anderson et al. | |
| 2012/0009830 | A1 | 1/2012 | Montena | |
| 2012/0190234 | A1 | 7/2012 | Montena | |
| 2012/0214335 | A1 | 8/2012 | Natoli et al. | |

OTHER PUBLICATIONS

U.S. Appl. No. 29/376,068, filed Oct. 1, 2010.
U.S. Appl. No. 29/387,881, filed Mar. 19, 2011.
U.S. Appl. No. 12/945,525, filed Nov. 12, 2010.
U.S. Appl. No. 13/237,563, filed Sep. 20, 2011.
PCT/US2010/050708. International Search Report and Written Opinion Date of Mailing: Jun. 29, 2011.
371 U.S. Appl. No. 13/248,789, filed Sep. 29, 2011, Conf. No. 1852.
CIP U.S. Appl. No. 13/401,835, filed Feb. 21, 2012.
EP10182355 Extended European Search Report. Date of Completion Dec. 6, 2010. 9 pp.
U.S. Appl. No. 29/398,963, filed Aug. 8, 2011.
Office Action Restriction Requirement (Mail Date: Aug. 7, 2012) for Cont. U.S. Appl. No. 13/248,789, filed Sep. 29, 2011.
Office Action (Mail Date: Oct. 15, 2012) for Cont. U.S. Appl. No. 13/248,789, filed Sep. 29, 2011.

* cited by examiner

COVER FOR CABLE CONNECTORS

CROSS-REFERENCE TO RELATED APPLICATIONS

The present application relates to the subject matter of applicant's U.S. patent application Ser. No. 12/398,857, now U.S. Pat. No. 7,731,512, the entirety of which is hereby incorporated by reference.

BACKGROUND OF THE INVENTION

1. Field of the Invention

The present invention relates to covers for cable connectors, and, more specifically, to covers that protect cable connectors from environmental degradation.

2. Description of the Related Art

Transmission line components such as connectors are often exposed to the open environment and are thus susceptible to degradation from weather related corrosive effects (e.g., moisture infiltration), pollution, debris and other elements. Degradation of the components potentially leads to degradation of the signal quality being transmitted through the cables.

To protect the components from environmental effects, layers of tape have been used to cover and seal the components, creating what have conventionally been referred to as tape-wrap seals. The tape layers typically consist of a first layer of electrical tape, followed by a layer of butyl tape, and then followed by another layer of electrical tape. While the layering of tape does in certain instances provide for a secure seal, it is not without its drawbacks.

First, the taping requires significant time in its initial installation, and needs to be removed in order to gain access to the component when servicing the components (and then reapplied after servicing is complete). The time associated with the taping and removal thereof when servicing the components is costly. In addition, the quality of the seal is dependant on the skill of the worker that is applying the tape. As such, inconsistent application of the tape may lead to instances of ineffective sealing of components.

Second, the properties inherent in the material composition of the tape subjects the tape to size fluctuation and inconsistent adherence. If the tape contracts in colder temperatures and loses adherence strength in warmer temperatures, for example, the quality of the seal created through the tape becomes compromised in regions that experience wide temperature fluctuation. In addition, the same pollutants and other environmental factors that affect the components when unsealed may also affect the sealing quality of the tape.

In addition to taping as a sealing provision, plastic clamshell or valise type covers have been used to envelop the components. These style covers are exemplified by the plastic material composition and the closure mechanisms used to open and close them around the components. While the opening and closing of the clamshell style cover facilitates quicker installation and removal in repair situations, it too is not without its drawbacks. For instance, the plastic material becomes brittle in colder temperatures, and this reduction in ductility increases over time. As the material becomes more brittle, the closure mechanisms lose their effectiveness often breaking or otherwise not reliably performing the closure function for which they were designed. Furthermore, the clamshell style closures include seams that extend essentially the entire periphery of the cover, making the sealing function much more difficult when compared to covers that do not include such long seams between parts. As such, the clamshell style covers lose their sealing effectiveness over time and in climates that routinely experience cold temperatures.

BRIEF SUMMARY OF THE INVENTION

It is therefore a principal object and advantage of the present invention to provide a cover for cable connectors or other components that may be quickly installed and/or removed.

It is another object and advantage of the present invention to provide a cable component cover that protects the cable connectors or other components from the environment.

It is yet another object and advantage of the present invention to provide a cable component cover that maintains its sealing properties regardless of temperature fluctuations.

It is a further object and advantage of the present invention to provide a cable connector cover that may be used in conjunction with other cable connector covers of various sizes and/or shapes.

Other objects and advantages of the present invention will in part be obvious, and in part appear hereinafter.

In accordance with the foregoing objects and advantages, a first aspect of the present invention provides a cover for a connector adapted to terminate a cable, wherein the connector includes a body portion and is adapted to terminate in a bulkhead. The cover comprises an elongated body comprising cable and bulkhead ends, interior and exterior surfaces, and the elongated body extends along a longitudinal axis. The interior surface includes a first region adapted to cover at least a portion of the cable and extends from the cable end to a first shoulder, wherein the first region is of a minimum, first cross-sectional diameter. The interior surface further includes a second region which is adapted to cover at least the connector body portion and which extends from the first shoulder to a second shoulder. The second region has a minimum, second cross-sectional diameter that is greater than the minimum, first cross-sectional diameter. The interior surface further includes a third region which is adapted to cover at least a portion of the connector and which extends from the second shoulder to the bulkhead end. The third region has a minimum, third cross-sectional diameter that is greater than the minimum, second cross-sectional diameter.

A second aspect of the present invention provides a cover for a connector adapted to terminate a cable wherein the exterior surface of the cover includes a first region that extends from the cable end to a third shoulder and includes a plurality of circumferential grooves therein. These circumferential grooves extend less than completely around the circumference of the first region of the exterior surface. The first region has a minimum, fourth cross-sectional diameter. The exterior surface of the cover further includes a second region that extends from the third shoulder to a fourth shoulder and has a minimum, fifth cross-sectional diameter that is less than the minimum, fourth cross-sectional diameter. The exterior surface of the cover further includes and a third region that extends from the fourth shoulder to the bulkhead end. This third region has a minimum, sixth cross-sectional diameter that is greater than the minimum, fifth cross-sectional diameter.

A third aspect of the present invention provides a cover for a connector adapted to terminate a cable, and which covers at least a portion of a second cover and at least a portion of a second connector. The first cover comprises an elongated body comprising cable and connector ends, as well as interior and exterior surfaces. The elongated body extends along a longitudinal axis. The interior surface of the first cover includes a first region which is adapted to cover at least a portion of the cable and which extends from the cable end to a first shoulder. The first region includes a plurality of grooves formed therein, and each of these grooves extends in spaced parallel relation to the others. The interior surface of the first cover includes a second region which is adapted to cover at least a portion of the connector and which extends from the first shoulder to a second shoulder. The interior surface of the first cover also includes a third region adapted to cover at least a portion of the second cover.

A fourth aspect of the present invention provides an adaptor in removable communication with the cover, wherein a portion of the adaptor is adapted to be positioned between the interior surface of the first cover and an exterior surface of the second cover. The adaptor can comprise internal and external surfaces as well as first connector and second connector ends. The external surface comprises a first region extending from the first connector end to a first shoulder. The first region includes a plurality of grooves formed therein, wherein each of the grooves extends in spaced parallel relation to the others. The external surface further comprises a second region extending from the first shoulder to the second connector end. This second region can comprise a variable cross-sectional diameter that gradually decreases from a maximum diameter at the first shoulder to a minimum diameter at the second connector end.

A fifth aspect of the present invention proves a system for covering both a first connector adapted to terminate a first cable and a second connector adapted to terminate a second cable. The system comprising a first elongated body comprising cable and bulkhead ends as well as interior and exterior surfaces. The elongated body extends along a longitudinal axis and is adapted to envelop at least a portion of the first connector. The interior surface includes a first region adapted to cover at least a portion of the cable and extends from the cable end to a first shoulder. The first region has a minimum, first cross-sectional diameter. The interior surface includes a second region that is adapted to cover at least the connector body portion and which extends from the first shoulder to a second shoulder. The second region has a minimum, second cross-sectional diameter that is greater than the minimum, first cross-sectional diameter. The interior surface includes a third region that is adapted to cover at least a portion of the connector and which extends from the second shoulder to the bulkhead end. The third region has a minimum, third cross-sectional diameter that is greater than the minimum, second cross-sectional diameter. The exterior surface includes a first region that extends from the cable end to a third shoulder and defines at least one, and in a preferred form a plurality of circumferential grooves therein. In an aspect of the invention, the circumferential grooves extend less than completely around the circumference of the first region of the exterior surface, although they could extend entirely around the circumference. The first region has a minimum, fourth cross-sectional diameter. The exterior surface of the cover includes a second region that extends from the third shoulder to a fourth shoulder. The second region has a minimum, fifth cross-sectional diameter that is less than the minimum, fourth cross-sectional diameter. The exterior surface of the cover includes a third region which extends from the fourth shoulder to the bulkhead end. The third region has a minimum, sixth cross-sectional diameter that is greater than the minimum, fifth cross-sectional diameter. A second elongated body is adapted to telescopically engage the first elongated body in enveloping relation to the second connector. The second elongated body comprises cable and bulkhead ends as well as interior and exterior surfaces, and is adapted to extend coaxially from the first body when engaged therewith. The second elongated body is adapted to envelop at least a portion of the second connector, and a portion of the first elongated body is adapted to be positioned between the interior surface of the second elongated body member and the first connector.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
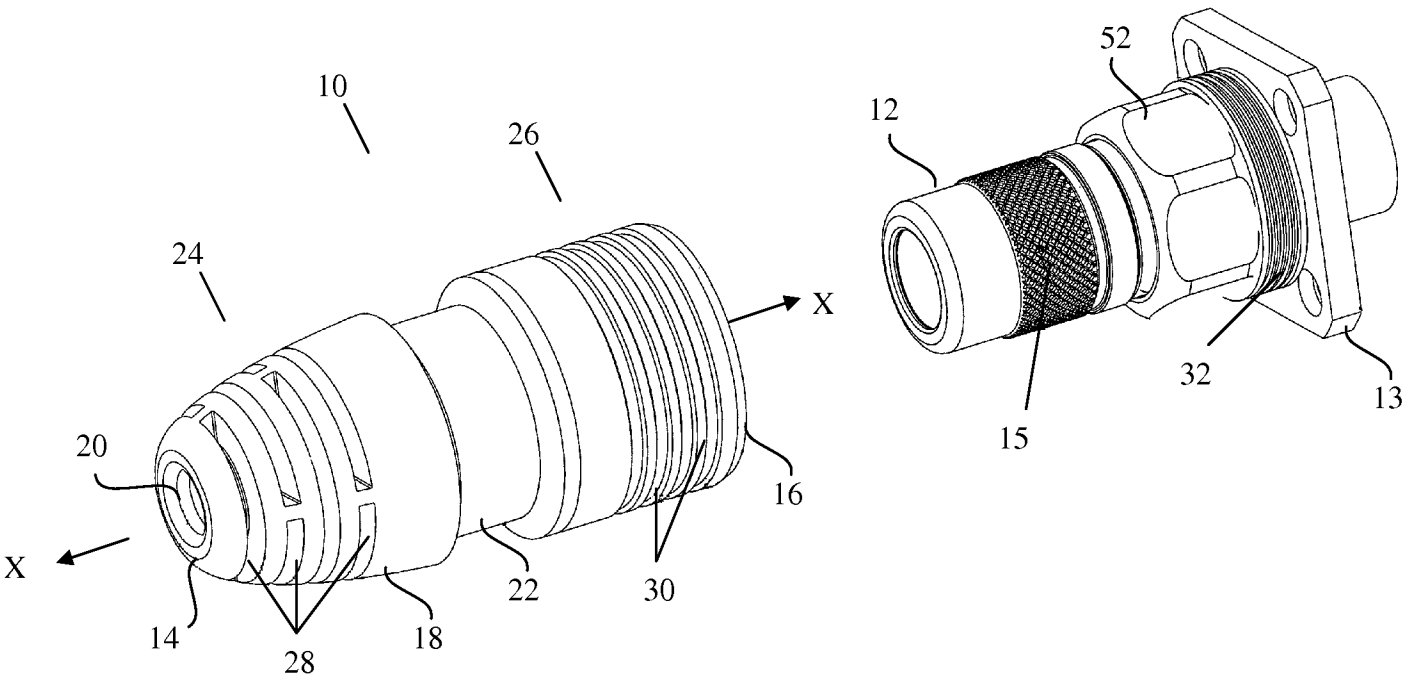
FIG. 1 is an exploded view of a first embodiment of a cover and cable connector assembly.

Referring now to the drawings, wherein like reference numerals refer to like parts throughout, there is seen in FIG. 1 a cover, designated generally by reference numeral 10, adapted to be placed in secure and sealing relation over a connector 12 (such as a 5-series connector manufactured by John Mezzalingua Associates, Inc. of East Syracuse, N.Y. that is adapted to terminate a ⅞" cable). Connector 12 terminates on a bulkhead 13. In the embodiment of FIG. 1, cover 10 comprises: an elongated body composed of a rubber material that exhibits a low modulus of elasticity over an extended temperature range, preferably a silicone rubber, that extends along a longitudinal axis X-X; a cable end 14; bulkhead end 16; exterior surface 18; interior surface 20; and an annular groove 22 of reduced diameter (when compared to the other sections of cover 10 as defined below) formed at a medial position in exterior surface 18. The rubber composition of the cover 10 permits it to elastically deform to the connector and other elements that it covers (e.g., the bulkhead), as will be described in greater detail hereinafter, when being installed or removed. In addition, the reduced diameter of medial section 22 provides a suitable gripping area for a gripping tool or fingers when installing cover 10 on a connector 12.

Cover 10 further comprises a cable end region 24 positioned on the cable receiving side of groove 22, and a bulkhead end region 26 positioned on the bulkhead side of groove 22. The cable end region 24 includes a plurality of strain relief grooves 28 formed therein with each groove 28 extending less than entirely around the circumference of exterior surface 18, although it should be noted that a single strain relief may be suitable in a particular application and the groove could extend entirely around the circumference. In one embodiment, two of the grooves are disconnected from one another by a gap between their ends, and are formed around the circumference of exterior surface in a common plane that extends transverse to the longitudinal axis X-X. In one embodiment, cable end region 24 is provided with a plurality of strain relief grooves 28 formed in co-planar pairs around exterior surface 18 and with each pairing extending in laterally spaced, parallel planes to one another.

Grooves 28 serve several purposes. Due to the interference type fit of cover 10 over connector 12, the material removal required to form grooves 28 facilitates easier stretching of the cover over the connector due to less surface contact, and hence friction, during the covering process. Grooves 28 further permit cover 10 to bend in the areas of grooves 28, thereby providing strain relief when the cable (not shown) is bent.

Bulkhead end region 26 comprises a series of grooves 30 formed entirely circumferentially around exterior surface 18 in spaced, parallel relation to one another. In this embodiment of the present invention, grooves 30 provide reservoirs in which liquid may collect. In one embodiment, grooves 30 provide pressure points to engage or otherwise frictionally interact with grooves on the inner surface of another cover, as will be described in greater detail hereinafter.

As shown in FIG. 1, connector 12 extends outwardly from bulkhead 13 along axis X-X. Bulkhead 13 includes a shank portion 32 that is either integral therewith or comprised of a separate element preferably composed of rubber. If shank portion 32 is integral with bulkhead 13, a rubber gasket (not shown) is preferably placed in sealing relation at the interface of shank portion 32 and the neck of bulkhead 13. Shank portion 32 is of a diameter having a dimension at least as large as, and preferably larger than the maximum width of coupling element/nut 52 (which is the next widest part of the connector), thus creating the connector's maximum width dimension at the interface of connector 12 and bulkhead 13.

Figure 2:
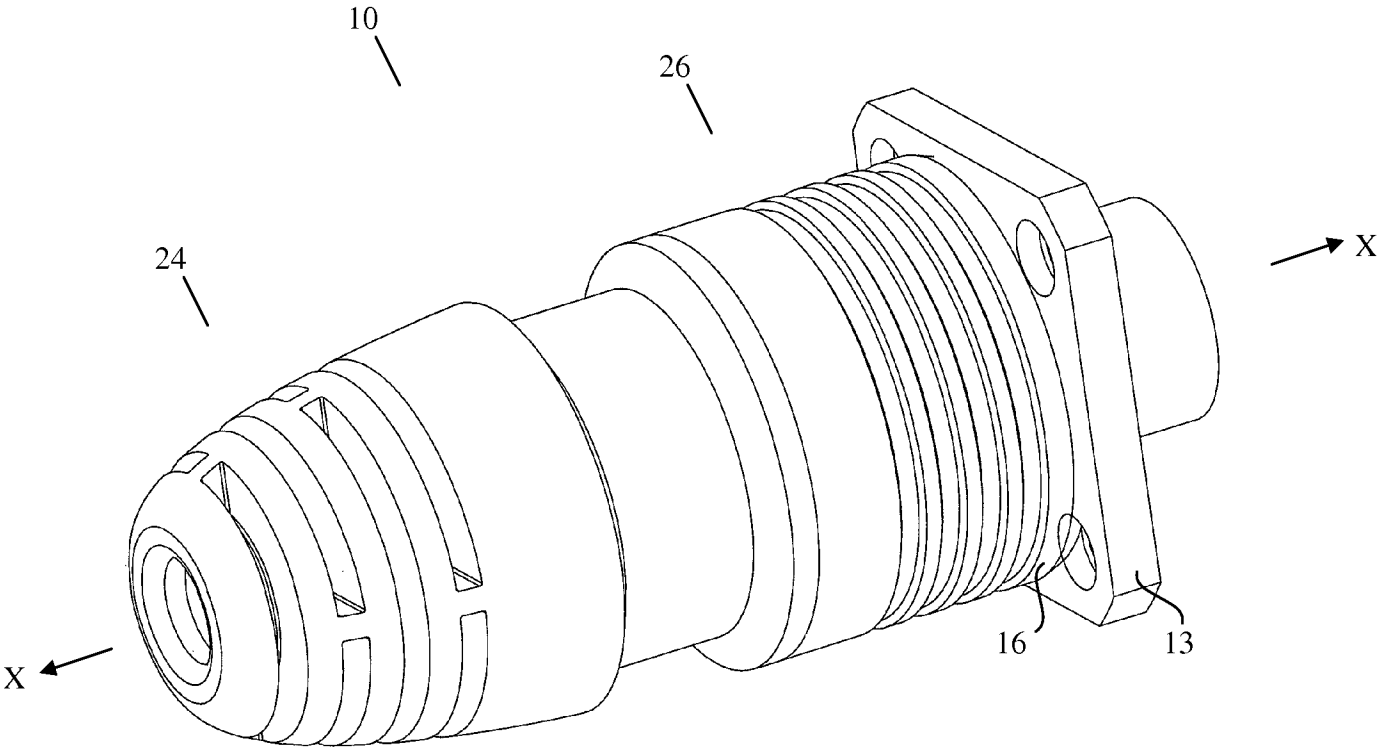
FIG. 2 is a side view of an assembled configuration thereof.

FIG. 2 depicts cover 10 fully assembled onto connector 12. In the assembled configuration, bulkhead end 16 of cover 10 is in reversible communication with bulkhead 13 to provide environmental protection.

Cover 10 (and all embodiments of the cover) is preferably pre-lubricated with a dry lubricant on its inside surface to ease the installation. Impregnating the rubber material composing the covers at the time of manufacture with an oil/grease composition is also effective in reducing the force required to install a cover over a connector.

Figure 3:
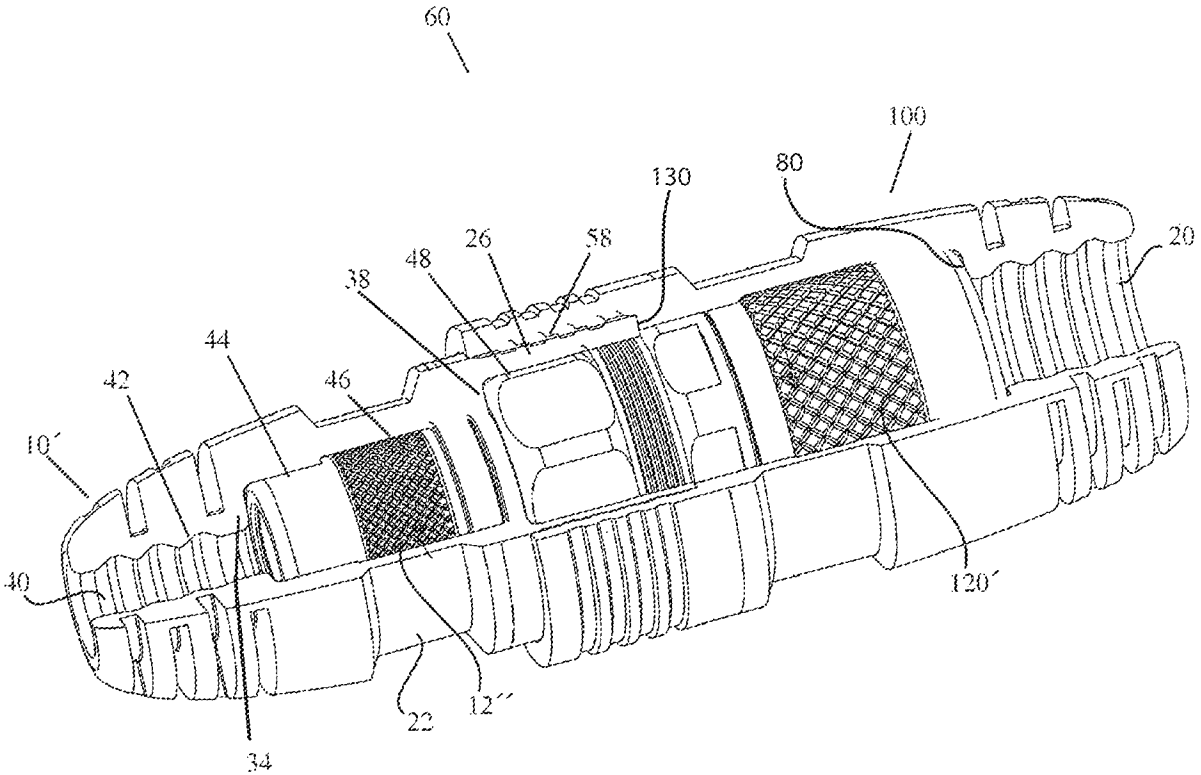
FIGS. 3-5 are partially cut-away perspective views of a second embodiment of a system of covers for providing cover to first and second cable connectors used to splice two differently sized cables.

Referring now to FIG. 3, the interior surface 40 of cover 10 includes a first region 42 that is of a serrated cross-section (and thus of continuously fluctuating diameter) and extends from cable end 14 to a first shoulder 34 from which it steps outwardly to a second region 44 of increased, essentially constant cross-sectional diameter. From this second region 44, the interior transitions outwardly via a step to the medial region's 22 interior diameter 46 where it remains essentially constant until shoulder 38 and then steps outwardly once more to a final internal region 48 that corresponds with bulkhead region 26. Region 48 is of an essentially constant cross-sectional diameter. These distinct regions of respective cross-sectional diameters securely envelop connector 12 and form seals at multiple points along the connector as will be described hereinafter.

In another embodiment of the invention, the interior surface 40 of cover 10 includes a first region 42 that extends from cable end 14, as shown in FIG. 1, to a first interior shoulder 34. This first region has a first cross-section diameter. At shoulder 34, interior surface 40 steps outwardly to a second region 44 having a second, essentially constant cross-sectional diameter. In this embodiment, the second cross-sectional diameter is larger than the first cross-sectional diameter. Looking at FIG. 1, the first interior region 42 with the first cross-sectional diameter would fit over region 15 of connector 12, and the second interior region 44 with the second cross-sectional diameter would fit over the coupling element/nut 52. These distinct regions of respective cross-sectional diameters securely envelop connector 12 and form seals at multiple points along the connector.

To use cover 10, the cover would first be fully slid (cable end 14 first) over a cable (not shown) that is to be terminated in connector 12, leaving the terminal end of the cable exposed. As the cover 10 is designed to have an interference fit with the cable, it may be useful to apply a small amount of grease to the outside of the cable jacket to assist in pulling the cover over the cable (although the preferred pre-lubricated rubber composition of cover may make such step unnecessary). The cable may then be terminated and attached to connector 12 in a conventional manner. Cover 10 would then be manually slid over connector 12 until its bulkhead end 16 preferably abuts, but at least overlaps with bulkhead 13. When cover 10 is fully positioned over connector 12, first region 24 of cover 10 tightly enwraps the cable with shoulder 34 positioned adjacent the terminating end of connector 12, thereby forming a seal between the cable and cover 10. If moisture does infiltrate the seal formed between the cable and cover 10 (due, for instance, to scratches or other removal of material that often occurs with the cable's jacket), the grooves 50 in first region 24 function as small reservoirs. Medial region 22 extends in tightly covering relation to the majority of connector 12, including its coupling element/nut 52 (although illustrated as a nut, various types of coupling elements are conventionally used on cable connectors of the type herein described) and the interface ring 44 that interfaces connector 12 with bulkhead 13, with a seal being formed at the junction of the interface ring 44 and medial region's 22 interior diameter 46. Shoulder 38 of cover 10 tapers outwardly (although it could be stepped instead of tapered) to accommodate shank portion 32, with internal region 48 adapted to cover the shank portion 32, with seals being formed between shank portion 28 and cover 10.

Figure 4:
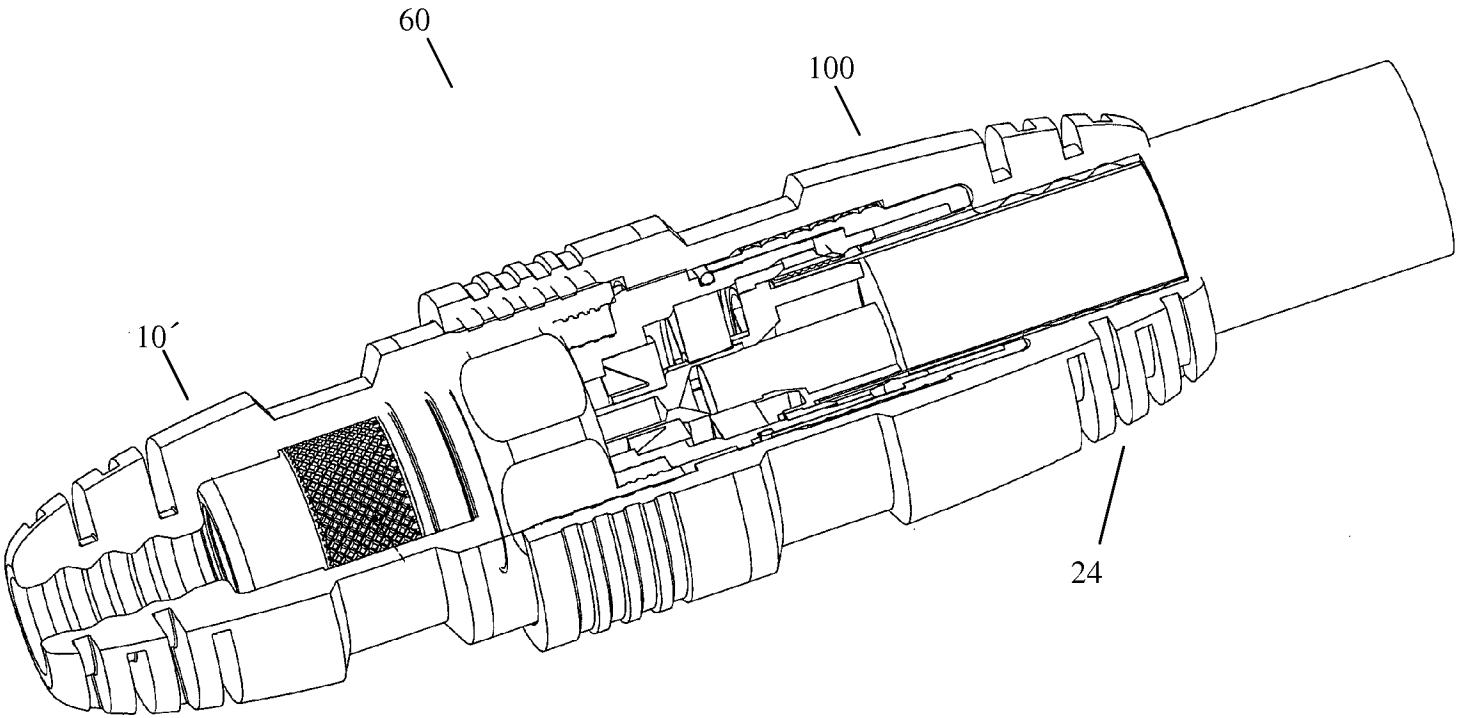
Figure 5:
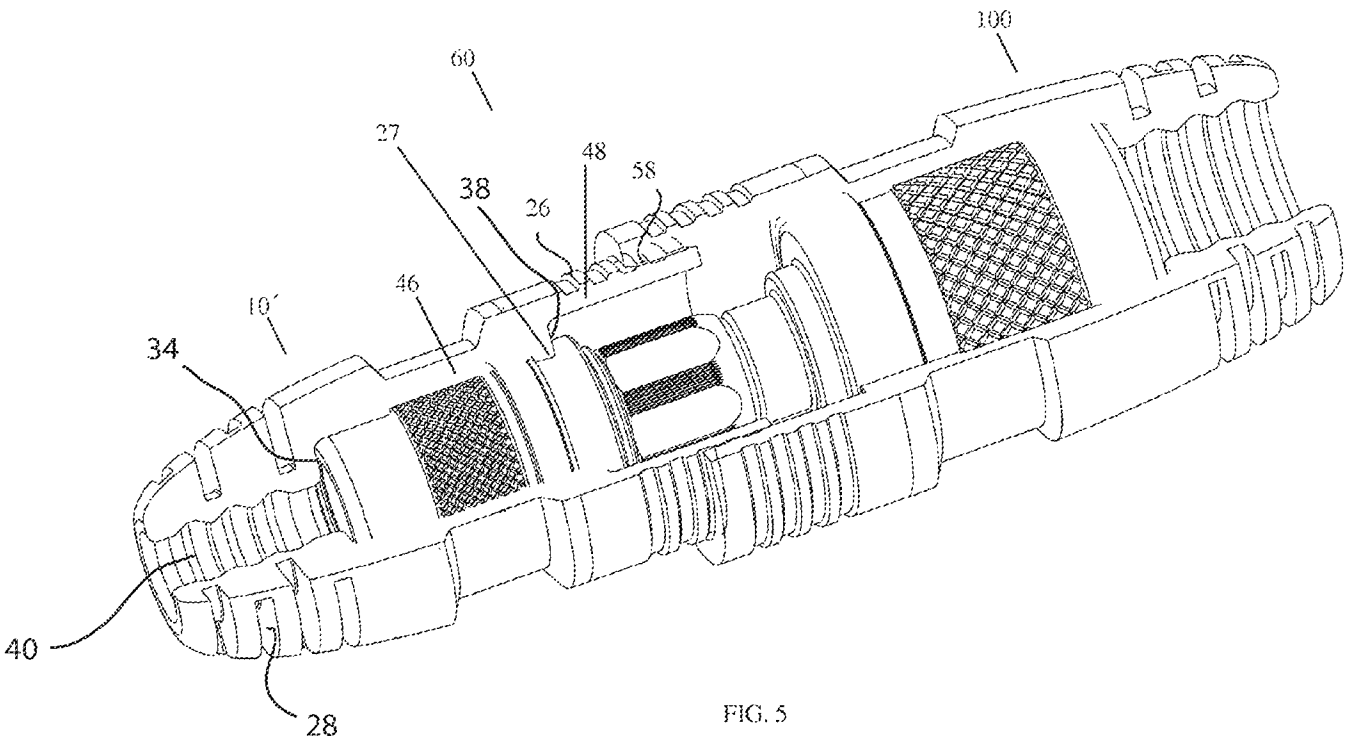

While cover 10 is adapted to be placed in covering relation to connectors that terminate in a bulkhead, with reference to FIGS. 3-5 there is seen a system for covering a pair of connectors that are used to splice together two differently sized cables. FIGS. 3-5 illustrate a system 60 of using covers 10 (which will be designated 10' for purposes of differentiating the bulkhead embodiments from the splice embodiment) and 100 to splice cables that terminate in connectors 12' and 120 (connectors 12' and 120 can be structurally the same as connectors 12 and 102 with the difference being the lack of a bulkhead for terminating the connectors since the connectors are joined together). The structures of covers 10' and 100 are the same as described above for cover 10, but with a different method of use and resultant arrangement.

FIG. 3 depicts covers 10' and 100 in a fully assembled configuration in system 60. In this configuration, the smaller cover 10' protects a smaller connector 12' (such as 4-series connector manufactured by John Mezzalingua Associates, Inc. of East Syracuse, N.Y. that is adapted to terminate a ½" cable) while the larger cover 100 protects a larger connector 120 (such as 5-series connector manufactured by John Mezzalingua Associates, Inc. of East Syracuse, N.Y. that is adapted to terminate a ⅞" cable). To position covers 10' and 100 into the assembled configuration, cover 10' is first slid over connector 12 as described above. Cover 100 is then slid over connector 120. To form a protective seal the internal region 58 of second cover 100, which is optionally of a serrated cross-section (and thus of continuously fluctuating diameter) as shown in FIG. 4, is slid over external region 26 of cover 10'. In addition to forming a protective seal, the interference fit between region 58 of second cover 100 and grooves 30 of region 26 in cover 10' inhibits removal of either cover without the application of force specifically directed toward disassembling the assembly.

Covers 10, 10', or 100 can be adapted to various configurations in order to protect the cable connector. Typically, the configuration of the cover will depend on the shape, size, or other physical characteristics of the connector. For example, in FIG. 3 internal surface 20 of second cover 100 is wider than internal surface 20 of covers 10 or 10' in order to encompass a larger connector or cable. In yet another embodiment shown in FIG. 4, region 24 of cover 100 is elongated to cover an elongated connector. In other embodiments, the cover can be as elongated as is necessary to protect the connector. FIG. 5 shows an assembled configuration in which internal region 58 of second cover 100 does not completely cover external region 26 of cover 10' due to the physical characteristics of the depicted cable connectors. The thickness of material between the external surface of the cover and the internal surfaces such as 42, 46, and 48 can also independently vary between very thin and very thick depending upon design requirements or the needs of the user.

FIG. 5 also depicts another important aspect of the present invention. As the interior of cover 10' transitions from region 46 to region 48, the cover can optionally include an annular ridge 27 that is of a similar or smaller diameter than internal region 46. During assembly, ridge 27 essentially snaps over the connector, creating yet another tight seal to further protect the cable connectors from prevent moisture and other environmental factors while inhibiting the removal of the cover without the application of force specifically directed toward disassembling the assembly.

Figure 6:
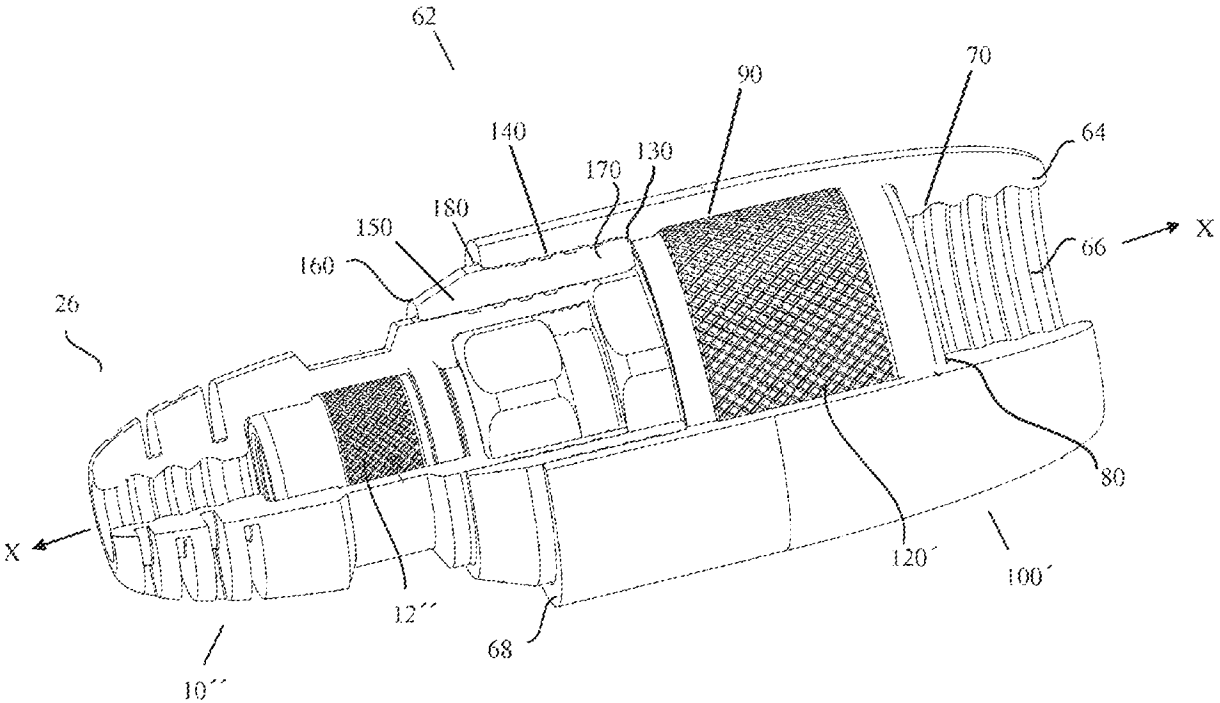
FIG. 6 is a partially cut-away perspective view of a third embodiment of a system of covers for providing cover to first and second cable connectors and using an adaptor.

FIG. 6 depicts another embodiment of the system for covering a pair of connectors that are used to splice together two differently sized cables. In this system 62, covers 10 and 100 (which are designated 10" and 100', respectively for purposes of differentiating the bulkhead embodiments from both the splice embodiment and previous system 60) splice cables that terminate in connectors 12" and 120' (connectors 12" and 120' can be structurally the same as or similar to connectors 12, 12', and 120 with the difference being the lack of a bulkhead for terminating the connectors since the connectors are joined together). The structures of cover 10" is the same as described above for cover 10 and 10', but with a different method of use and resultant arrangement.

In contrast, the structure of cover 100' is different from the structure of the previous covers. Cover 100' is adapted to be placed in secure and sealing relation over a connector (such as a 6-series connector manufactured by John Mezzalingua Associates, Inc. of East Syracuse, N.Y. that is adapted to terminate a 1 & ¼" cable) or another cover. In the embodiment of FIG. 6, cover 100' comprises: an elongated body composed of a rubber material that exhibits a low modulus of elasticity over an extended temperature range, preferably a silicone rubber, that extends along a longitudinal axis X-X; a cable end 64; interior surface 66; and a cable connector end 68. The interior surface 66 of cable end 64 of cover 100' includes a first region 70 that is a serrated cross-section (and thus of continuously fluctuating diameter) and extends from cable end 64 to a first shoulder 80 from which the interior surface steps outwardly to a second region 90 of increased, essentially constant cross-sectional diameter. From this second region 90, the interior transitions inwardly to shoulder 130, thence outwardly to a final region 140. The interior surface of region 140 is of an essentially constant cross-sectional diameter. These distinct regions of respective cross-sectional diameters securely envelop both connector 120' and cover 10" to form seals at multiple points as will be described hereinafter.

FIG. 6 depicts covers 10" and 100' in a fully assembled configuration in system 62. In this configuration, the smaller cover 10" protects a smaller connector 12" (such as 4-series connector manufactured by John Mezzalingua Associates, Inc. of East Syracuse, N.Y. that is adapted to terminate a ½" cable) while the larger cover 100' protects a larger connector 120' (such as 6-series connector manufactured by John Mezzalingua Associates, Inc. of East Syracuse, N.Y. that is adapted to terminate a 1 & ¼" cable). To position covers 10" and 100' into the assembled configuration, cover 10" is first slid over connector 12" as described above. Cover 100' is then slid over connector 120'. To form a protective seal region 140 of second cover 100' is slid over the connector region of cover 10". In addition to forming a protective seal, the interference fit between the interior surface of cover 100' and the grooves 30 of the connector region of cover 10" inhibits removal of either cover without the application of force specifically directed toward disassembling the assembly. Furthermore, having the plurality of grooves 30 provides redundancy in terms of inhibiting moisture migration; if one of the peaks forming grooves 30 is sliced or otherwise compromised, moisture may infiltrate and reside in the valley of that groove (i.e, each valley provides a successive reservoir for moisture containment).

Figure 7A:
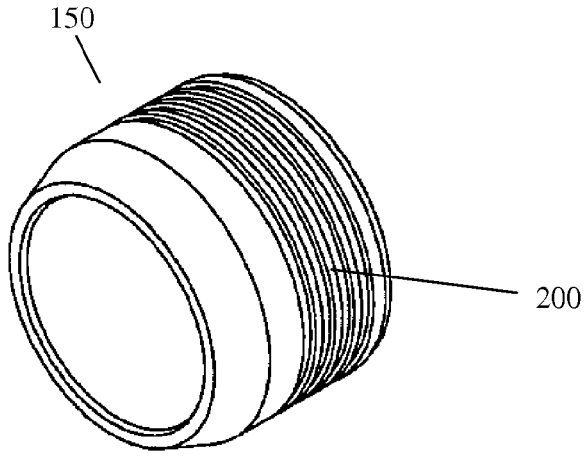
FIG. 7A is a side view of a first embodiment of an adaptor.
Figure 7B:
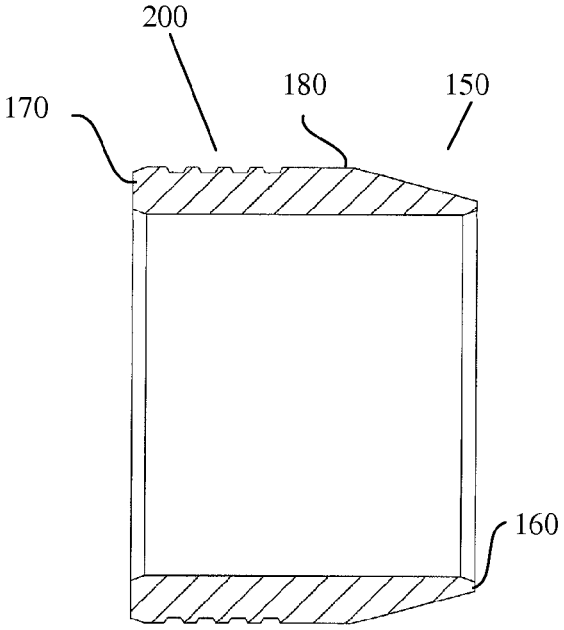
FIG. 7B is a bisecting cut-away view of one embodiment of the adaptor.

FIG. 6 also depicts an adaptor 150 used in conjunction with the cable covers to further protect the cable connectors from prevent moisture and other environmental factors. Specifically, adaptor 150 is used to fill the space left by two covers of non-interfering dimensions. For example, in FIG. 6, the interior diameter of the connector end of cover 100' is greater than the outer diameter of the connector end of cover 10", thereby creating a gap that would allow moisture to directly access the cable connectors. Adaptor 150 is used to fill that gap. As shown more clearly in FIGS. 7A and 7B, adaptor 150 comprises: an elongated body composed of a hard plastic material (e.g., glass filled nylon), although other materials, including metal, could be used, that has a higher modulus of elasticity than the elastomeric rubber material of the covers and that extends along a longitudinal axis X-X; a first end 170; and a second end 160. The exterior surface of the adaptor defines a region 200 which extends from first end 170 to a first shoulder 180. Region 200 is of serrated cross-section (and thus of continuously fluctuating diameter). In one embodiment of the adaptor, the diameter of the exterior surface gradually decreases from a maximum diameter at shoulder 180 to a minimum diameter at second end 160, although many other designs are possible.

To position the covers and adaptor 150 into the assembled configuration shown in FIG. 6, cover 10" is first slid over connector 12" as described above. The adaptor is then fully slid over cover 10", with second end 160 of the adaptor sliding over the connector end of cover 10" (although the adaptor could alternatively be slid onto the cable end of cover 10", with first end 170 of the adaptor sliding onto the cover first). In this configuration, the interference fit between the interior surface of adaptor 150 and the grooves 30 of the connector region of cover 10" inhibits removal of the adaptor without the application of force specifically directed toward disassembling the assembly (the differing material compositions of adapter 150 and any of the covers does facilitate movement with slightly less force than would be required if the adapter was also composed of the same elastomeric material as the covers). Cover 100' is then slid over connector 120'. To form a protective seal, region 140 of second cover 100' is slid over the region 200 of adaptor 150. In addition to forming a protective seal, the interference fit between the interior surface of cover 100' and the serrated exterior surface of region 200 of the adaptor inhibits removal of either cover without the application of force specifically directed toward disassembling the assembly.

Figure 7C:
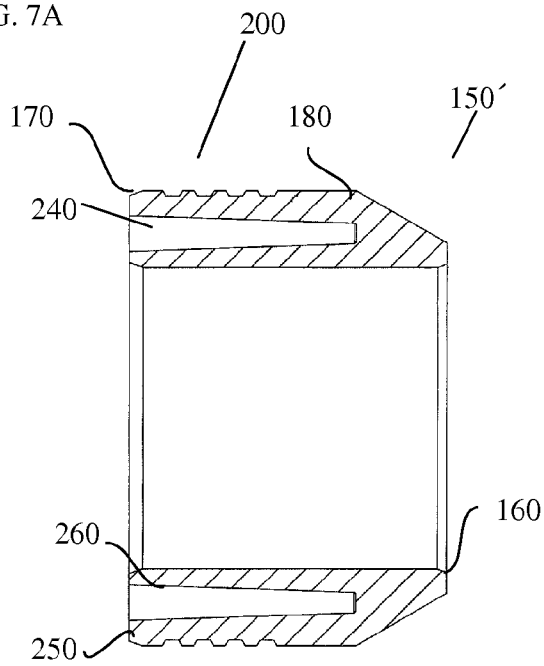
FIG. 7C is a bisecting cut-away view of another embodiment of the adaptor.
Figure 8:
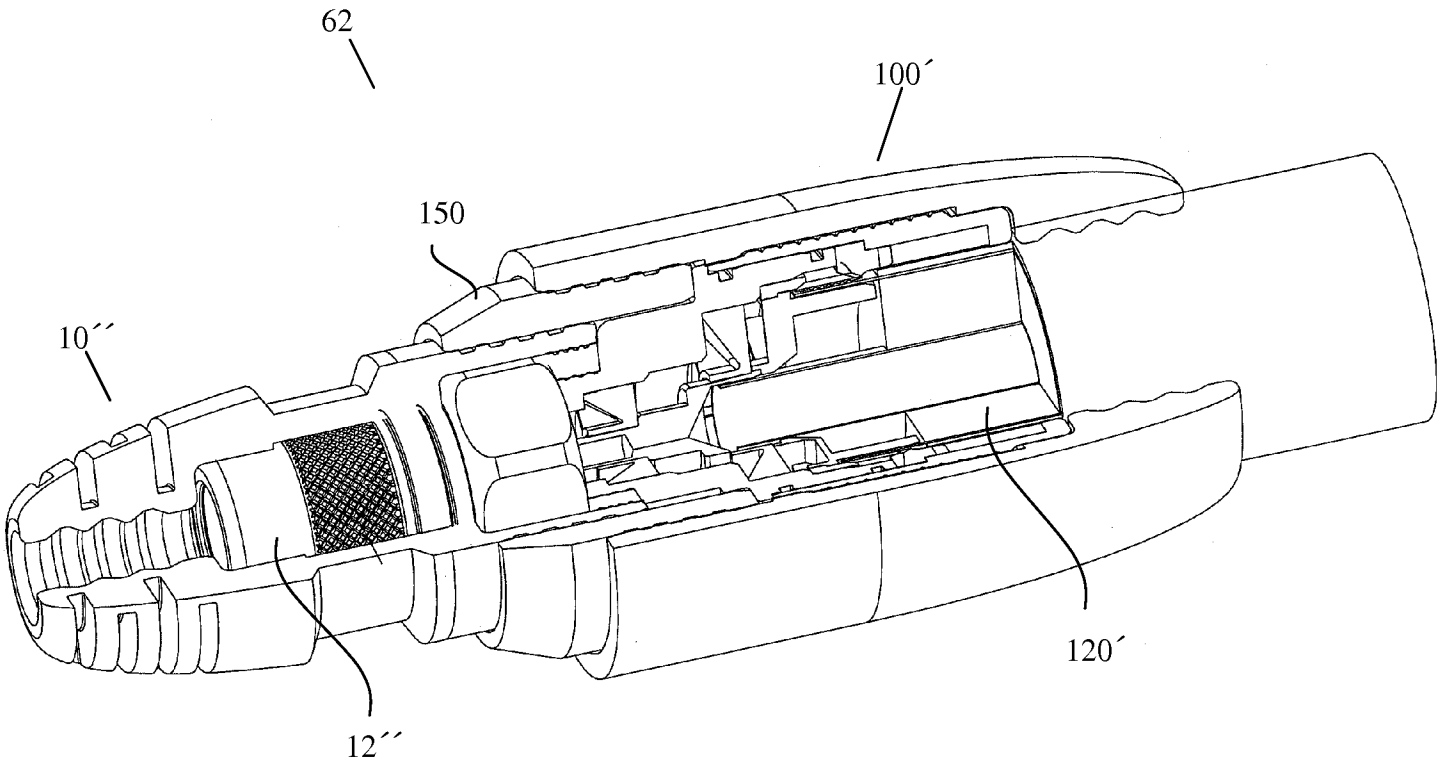
FIG. 8 is a partially cut-away perspective view of a third embodiment of a system of covers for providing cover to first and second cable connectors and using an adaptor.
Figure 9:
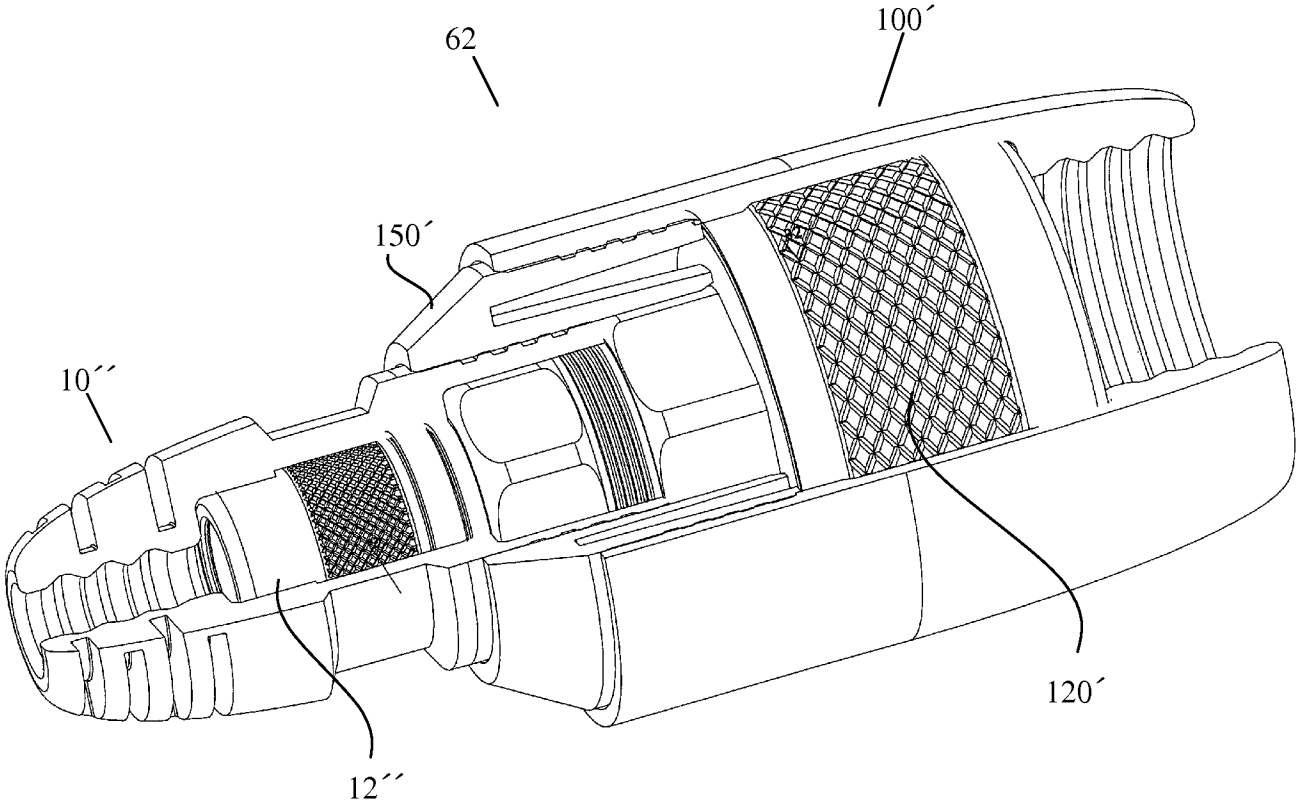
FIGS. 9-11 are partially cut-away perspective views of a fourth embodiment of a system of covers for providing cover to first and second cable connectors and using an adaptor.

FIGS. 7C and 9 show another embodiment of adaptor 150 (hereinafter referred to as 150'). In this embodiment, adaptor 150' comprises: an elongated body composed of a hard plastic material, that extends along a longitudinal axis X-X; a first end 170; and a second end 160. The exterior surface of the adaptor includes a first region 200 that extends from first end 170 to a first shoulder 180, and which is of a serrated cross-section (and thus of continuously fluctuating diameter). In one embodiment of adaptor 150', the diameter of the exterior surface gradually decreases from a maximum diameter at shoulder 180 to a minimum diameter at second end 160. The first end 170 of adaptor 150', however, is structurally different from that of the previous embodiment of the adaptor. The elongated body of adaptor 150' defines a cavity 240 that begins at shoulder 180 and terminates at first end 170. At shoulder 180, the elongated body of the adaptor bifurcates into a larger outer circumferential flexible body 250 and a smaller inner circumferential flexible body 260, which are separated by cavity 240. Additionally, the distance between outer body 250 and inner body 260 (and thus the size of cavity 240) increases gradually from a minimum first distance at shoulder 180 to a maximum distance at first end 170.

Figure 10:
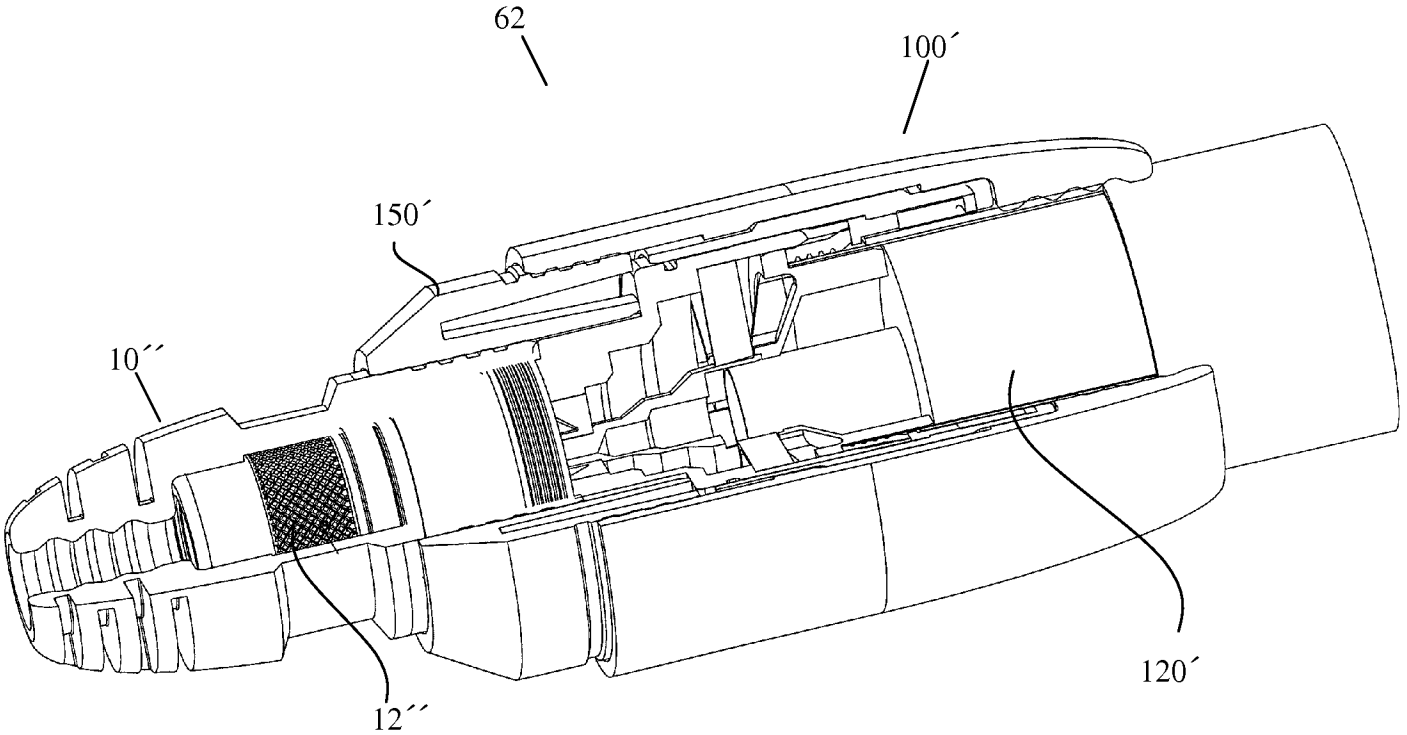
Figure 11:
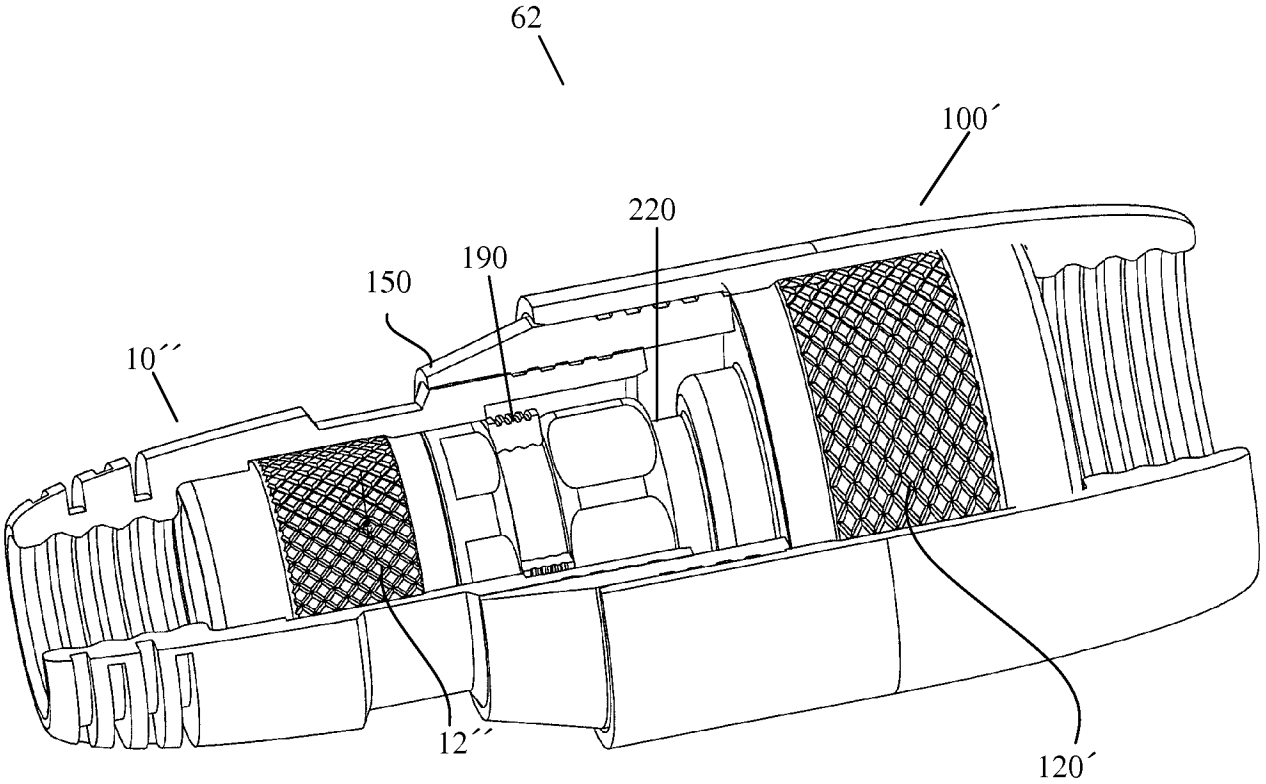

In use, adaptor 150' in FIGS. 7C and 9 serves to fill the space left by two covers of non-interfering dimensions, as described above. The bifurcated structure and cavity of adaptor 150' allows the adaptor to fill a wider variety of gaps using a wider variety of covers. For instance, while some covers will completely encompass the outer serrated surface of adaptor 150' (see, e.g. FIG. 9), other covers will only partially encompass the outer serrated surface of the adaptor (see, e.g. FIG. 10), typically as a result of the underlying cable connectors. Adaptor 150' allows the serrated outer surface to adapt to both configurations. Additionally, if the inner circumference of the connector end of cover 100' is smaller than the outer circumference of adaptor 150', the cavity of the adaptor can be compressed during assembly to allow cover 100' to slide over the adaptor. Adaptor 150' is positioned into the assembled configuration depicted in FIG. 9 as described above.

Although the present invention has been described in connection with a preferred embodiment, it should be understood that modifications, alterations, and additions can be made to the invention without departing from the scope of the invention as defined by the claims.

What is claimed is:

1. A first cover for a connector adapted to terminate a cable, and further covering at least a portion of a second cover, said second cover covering at least a portion of a second connector, said first cover comprising:

a. an elongated body comprising cable and connector ends, interior and exterior surfaces;

b. wherein said interior surface comprises a first region adapted to cover at least a portion of the cable and extending from said cable end to a first shoulder, said first region comprising a plurality of grooves formed therein, wherein each of said grooves extends in spaced parallel relation to the others, a second region adapted to cover at least a portion of the connector and that extends from said first shoulder to a second shoulder, a third region adapted to cover at least a portion of said second cover; and c. an adaptor in removable communication with at least one of the first cover and the second cover, wherein a portion of said adaptor is adapted to be positioned between said interior surface of said first cover and an exterior surface of said second cover, wherein said adaptor comprises internal and external surfaces, first and second ends, wherein said external surface comprises a first region extending from said first end to a first shoulder, said first region comprising a plurality of grooves formed therein, wherein each of said grooves extends in spaced parallel relation to the others, and a second region extending from said first shoulder to said second end.

2. The cover of claim 1, wherein said first region has a minimum, first cross-sectional diameter, and said second region has a second cross-sectional diameter that is greater than said first cross-sectional diameter.

3. The cover of claim 1, wherein said second region comprises a variable cross-sectional diameter, said variable cross-sectional diameter gradually decreasing from a maximum diameter at said first shoulder to a minimum diameter at said second end.

4. The cover of claim 1, wherein said first region is adapted to be positioned between said interior surface of said first cover and an exterior surface of said second cover.

* * * * *